US008881913B2

(12) United States Patent
Samarkos

(10) Patent No.: US 8,881,913 B2
(45) Date of Patent: Nov. 11, 2014

(54) WASTE SORTING APPARATUS AND METHOD

(76) Inventor: Manuel Samarkos, Victoria (AU)

( * ) Notice: Subject to any disclaimer, the term of this patent is extended or adjusted under 35 U.S.C. 154(b) by 0 days.

(21) Appl. No.: 13/700,830

(22) PCT Filed: May 31, 2011

(86) PCT No.: PCT/AU2011/000654

§ 371 (c)(1),
(2), (4) Date: Jan. 2, 2013

(87) PCT Pub. No.: WO2011/150452

PCT Pub. Date: Dec. 8, 2011

(65) Prior Publication Data

US 2013/0126401 A1 May 23, 2013

(30) Foreign Application Priority Data

May 31, 2010 (AU) ..... 2010902380

(51) Int. Cl.

| | |
|---|---|
| ***B07C 5/16*** | (2006.01) |
| ***B07C 7/04*** | (2006.01) |
| ***B03B 9/06*** | (2006.01) |
| ***B07B 13/08*** | (2006.01) |
| ***B07B 13/00*** | (2006.01) |

(52) U.S. Cl.

CPC . *B07B 13/08* (2013.01); *B07C 7/04* (2013.01); *B03B 9/06* (2013.01); *B07B 13/00* (2013.01)

USPC ..... 209/645

(58) Field of Classification Search

USPC ..... 209/630, 645, 702, 942

See application file for complete search history.

(56) References Cited

U.S. PATENT DOCUMENTS

| | | | | |
|---|---|---|---|---|
| 5,009,370 | A * | 4/1991 | Mackenzie | 241/24.12 |
| 5,249,690 | A * | 10/1993 | Patterson | 209/630 |
| 5,263,591 | A * | 11/1993 | Taormina et al. | 209/630 |
| 5,464,100 | A * | 11/1995 | Oka | 209/31 |

FOREIGN PATENT DOCUMENTS

| | | | |
|---|---|---|---|
| FR | 2800304 | A1 | 5/2001 |
| WO | 2005120729 | A1 | 12/2005 |

OTHER PUBLICATIONS

International Search Report and Written Opinion of the ISA, ISA/AU, Woden ACT, mailed Aug. 1, 2011.
European extended Search Report dated Feb. 12, 2104.
First Examination Report from corresponding New Zealand Application dated May 27, 2014 (2 pages).

* cited by examiner

*Primary Examiner* — Terrell Matthews
(74) *Attorney, Agent, or Firm* — Harness, Dickey & Pierce, PLC

(57) ABSTRACT

A waste sorting apparatus including: an input conveyor for conveying an input stream of mixed waste materials including items of a plurality of different types; a plurality of output conveyors for conveying respective output streams of said waste materials; and a plurality of operator stations for respective human operators, wherein the input conveyor and the plurality of output conveyors are configured to be accessible from each operator station to allow each operator to sort items of said different types from the input stream to respective ones of the output streams, each of the output streams including sorted items of a corresponding one of said types, and wherein at least one of the output conveyors is a far-side output conveyor on the far side of the input conveyor from the operator stations to allow each operator to throw items to the far-side output conveyor over the input conveyor.

21 Claims, 4 Drawing Sheets

WASTE SORTING APPARATUS AND METHOD

CROSS-REFERENCE TO RELATED APPLICATIONS

This application is a 371 U.S. National Stage of International Application No. PCT/AU2011/000654, filed May 31, 2011 and published in English as WO 2011/150542 A1 on Dec. 8, 2011. This application claims priority to Australian Patent Application No. 2010902380, filed May 31, 2010. The disclosures of the above applications are incorporated herein by reference.

FIELD

The present invention relates to apparatuses and methods for waste sorting and processing, for example sorting mixed waste materials in a recycling plant for recycling/re-using at least some of the materials, e.g., construction and demolition materials.

BACKGROUND

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Conventional rubbish and waste sorting plants generally include a central conveyor belt carrying a mix of materials. The mix of materials are sorted into bins or containers by human operators who stand adjacent the central conveyor belt. The operators stand above a series of fixed bins, immediately below each operator, and throw or drop items picked from the central conveyor into the bins. Each bin is designated for collecting a different type of material, e.g., brick, timber etc. Each operator is assigned to select and pick only one type of item from the incoming mix of materials, and drop items of that type into the bin allocated for that type. If the mix of materials includes a large proportion of items of one particular type, a plurality of operators can be assigned to pick that type of item.

The inventor has identified a number of problems or difficulties with conventional rubbish sorting plants, including one or more of the following:

(a.) due to the unskilled nature of waste sorting, human resource issues are endemic, and often adversely affect the performance of a waste sorting plant; for example, high operator absenteeism can result in items of an absent operator's type ending up in the landfill component (at the end of the conveyor) because the operator is absent from his or her station, or because the volume or flow rate of items of the one particular type is too great for the remaining operators to handle;

(b.) all operators need to be present at their respective stations for conventional systems to work most efficiently, and operators do not work efficiently if their corresponding type of material is not uniformly or consistently present in the mix;

(c.) the conveyor belt needs to stop while the bins below the operators are emptied, resulting in lost productivity;

(d.) the quality or purity of separation of the sorted materials can be insufficiently consistent or high; and (e.) some recycling plants may be configured only to receive small and/or consistently sized items (e.g., small bottles as found in domestic waste), and/or may be complicated and/or expensive to construct and maintain.

It is desired to address or ameliorate one or more disadvantages or limitations associated with the prior art, or to at least provide a useful alternative.

SUMMARY

In accordance with the present invention, there is provided a waste sorting apparatus including:

an input conveyor for conveying an input stream of mixed waste materials including items of a plurality of different types;

a plurality of output conveyors for conveying respective output streams of said waste materials; and a plurality of operator stations for respective human operators, wherein the input conveyor and the plurality of output conveyors are configured to be accessible from each operator station to allow each operator to sort items of said different types from the input stream to respective ones of the output streams, each of the output streams including sorted items of a corresponding one of said types, and wherein at least one of the output conveyors is a far-side output conveyor on the far side of the input conveyor from the operator stations to allow each operator to throw items to the far-side output conveyor over the input conveyor.

The present invention also provides a waste sorting method including:

conveying an input stream of mixed waste materials including items of a plurality of different types to a plurality of human operators;

sorting by the human operators of items of different types from the input stream to respective ones of a plurality of output streams; and conveying the plurality of output streams from the human operators, each of said output streams including sorted items of a corresponding one of said types, wherein the sorting includes throwing items of at least one type over and beyond the input stream to a corresponding one of said output streams.

The present invention also provides a waste sorting apparatus including:

an input conveyor for conveying an input stream of mixed waste materials including items of a plurality of different types;

a plurality of output conveyors for conveying respective output streams of said waste materials; and a plurality of operator stations for respective human operators, wherein the input conveyor and the plurality of output conveyors are configured to be accessible from each operator station to allow each operator to sort items of said different types from the input stream to respective ones of the output streams, each of the output streams including sorted items of a corresponding one of said types.

The present invention also provides a waste sorting method including:

conveying an input stream of mixed waste materials including items of a plurality of different types to a plurality of human operators;

sorting by the human operators of items of different types from the input stream to respective ones of a plurality of output streams; and conveying the plurality of output streams from the human operators, each of said output streams including sorted items of a corresponding one of said types.

In some embodiments, the far-side output conveyor can be substantially open to receive items along a substantial portion of its length adjacent each operator station.

The number of output conveyors can be two, three, four, or five.

The output conveyors can be generally parallel to the input conveyor and the plurality of operator stations.

The waste sorting apparatus can be configured such that each operator can sort the items from the input stream to the plurality of output streams by manually distributing the items onto the respective output conveyors, wherein manually distributing can include one or more of placing, throwing, dropping, or dropping through chutes leading from the operator stations to one or more of the output conveyors.

A flow rate of the input stream can be controlled based on:

the quality of separation of the items into the plurality of output streams; and/or the number of operators at the operator stations.

The waste sorting apparatus can include a variable feed supply to supply the input stream to the input conveyor at the controlled flow rate. The variable feed supply can include a feed hopper and a feed hopper conveyor controlled by a user.

The waste sorting apparatus can include:

at least one collector located adjacent a terminal end of at least one output conveyor for collecting items of the corresponding item type from the corresponding output stream; and/or at least one baler located adjacent a terminal end of at least one output conveyor for collecting and baling items of the corresponding item type from the corresponding output stream.

At least one output conveyor for a first item type (e.g., rubbish) can be configured to operate in reverse as an output conveyor for a second item type (e.g., cardboard/paper).

At least one conveyor can include a plurality of conveyor belts arranged to carry the corresponding stream.

The operator stations can be mutually spaced along the input conveyor.

The waste sorting apparatus can include at least one shredder for shredding mixed waste to form items in the input stream suitable for sorting by the operators.

At least one output conveyor for a heavy item type (e.g., timber, brick, concrete or metal) can be distant from the operator stations such that heavy items can be thrown by the operators to the distant output conveyor past (e.g., over or under) at least one of the other conveyors.

At least one output conveyor for a light item type (e.g., rubbish, paper or cardboard) can be adjacent (e.g., above, below or next to) the operator stations such that light items can be dropped or placed by the operators onto the adjacent output conveyor.

The throwing can include throwing items onto a substantially open portion of an output conveyor corresponding to the one of said output streams.

The plurality of output streams can include two, three, four or five output streams.

The output streams can be generally parallel to the input stream.

The waste sorting method can include controlling a flow rate of the input stream based on:

the quality of separation of the items into the plurality of output streams; and/or the number of operators.

The waste sorting method can include:

the operators throwing heavy items to at least one output stream past (e.g., over or under) at least one of the other streams; and/or the operators dropping light items to at least one output stream adjacent (e.g., below or next to) the input stream.

The waste sorting method can include shredding mixed waste to form items in the input stream suitable for sorting by the operators.

The waste sorting method can include operating at least one output conveyor for a first item type (e.g., rubbish) in reverse as an output conveyor for a second item type (e.g., cardboard/paper).

BRIEF DESCRIPTION OF THE DRAWINGS

Preferred embodiments of the present invention are hereinafter further described, by way of example only, with reference to the accompanying drawings, in which.

DETAILED DESCRIPTION

Overview

Figure 1:
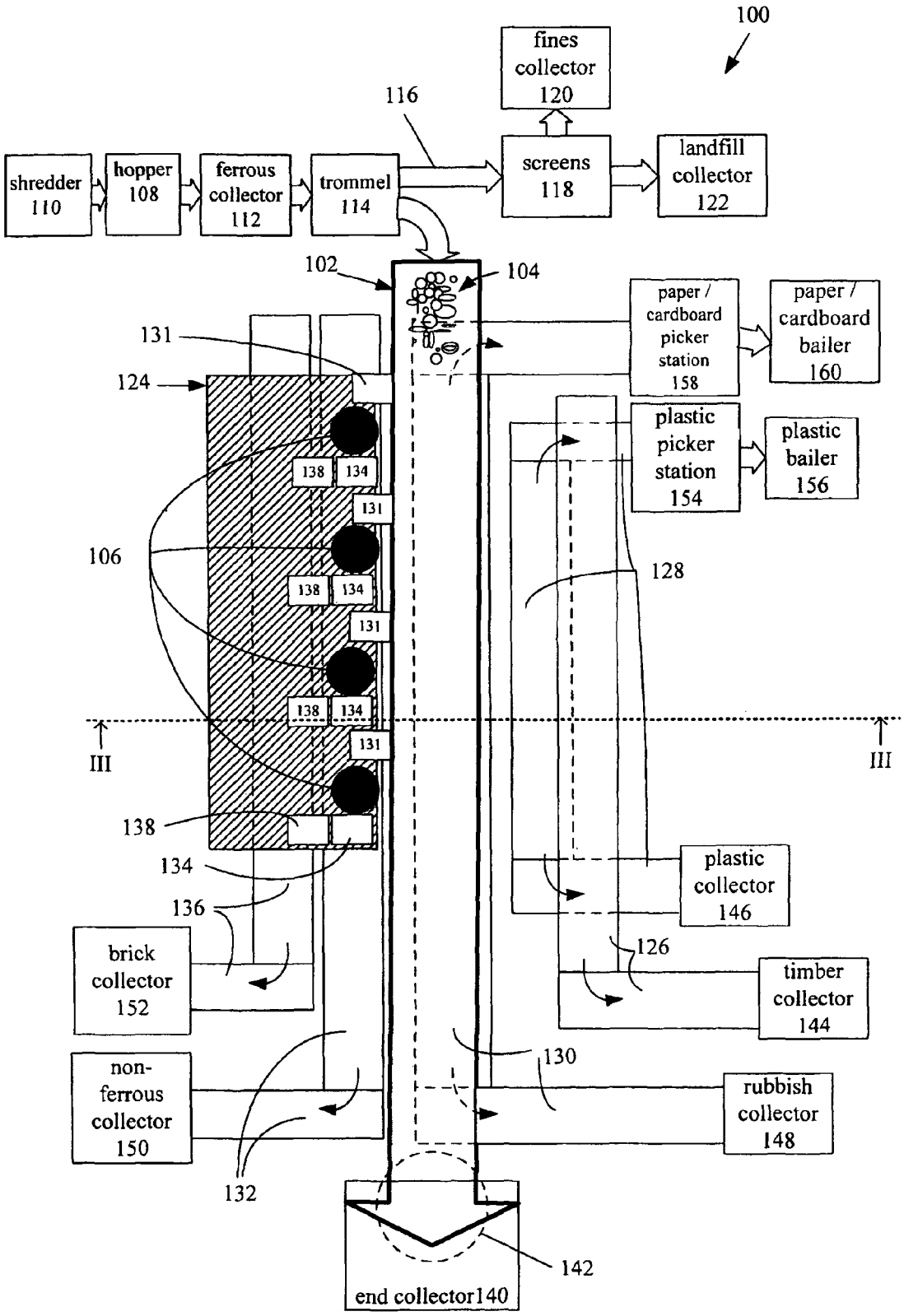
FIG. 1 is a schematic diagram of a plan view of an embodiment of a sorting apparatus.

A material sorting plant 100 (or material sorting apparatus), as shown in FIG. 1, includes a shed, or building, housing an input conveyor 102 for carrying an input stream 104 of mixed waste materials to a plurality of operator stations 106 (which are also referred to as "picking stations"). The operator stations 106 are locations or standing points for use by one human operator (also referred to as a "sorter" or "picker") per station 106. Each operator station 106 can include an area or place for a person to stand and move while sorting or picking, and/or a seat or chair for the operator to sit, etc. The operator stations 106 are located along the input conveyor 102 so that the input stream 104 on the input conveyor 102 is manually accessible by each of the operators at the operator stations 106. The plant 100 includes a plurality of output conveyors, which are also accessible by the operators. Each output conveyor carries an output stream of items, of the same type, which have been separated from the input stream 104 by the operators. For example, the items may include substantially only timber items in one output stream and substantially only brick items in another output stream. The operator stations are mutually spaced (e.g., by about two to three meters) along the input conveyor so that each operator has sufficient space to access the input and output conveyors and thus sort the items from the input stream 104 to the plurality of output streams.

The plant 100 includes a plurality of collectors, with at least one collector located adjacent each output conveyor for collecting, the corresponding type of material from the corresponding output stream. The collectors can be bins, hoppers, skips, or balers, or simply designated locations for receiving the output stream items, e.g., to form a pile or heap of material that can be subsequently loaded into a carrying device by a front-end loader or other loading machine. The collectors can include gates or doors that are held closed to collect the output stream, then opened when the collectors are to be emptied, e.g., to a carrying device or skip.

The mixed waste materials can be waste products from building sites, e.g., from demolition of domestic or commercial buildings, that can be recycled and re-used once separated. The mixed waste can also be municipal solid waste from a municipal waste collection service, electronics waste from electrical or electronic products, automotive waste from vehicles, civil engineering waste from civil demolitions or road works, rocks, metals, plastics, etc.

Example material types (also referred to as "fractions") include: timber, brick, stone/rock, concrete, ferrous metal, non-ferrous metal, earth/soil/dirt, plastic, glass, and rubbish. Ferrous metal items include items rich in magnetic materials such as soft iron. Non-ferrous metal items include metallic or metal-rich items that are generally non-magnetic, e.g., aluminium cans, copper, stainless steel, brass, etc. Plastic items include plastic bags, plastic bottles, plastic construction materials, etc. In some sorting plants, different types of plastic are sorted as different material types, e.g., recyclable plastic, non-recyclable plastic, high-density polyethylene (HDPE) and polyethylene terephthalate (PET). Glass items include glass bottles and pieces of broken glass. In some sorting plants, different types of glass are sorted as different material types, e.g., green glass, brown glass and clear glass. Rubbish items include organic matter, food scraps, manufactured timbers, insulation etc. Other example types of materials that are sorted include paper and cardboard.

During operation of the plant 100, each operator can manually sort items of each type of waste from the input conveyor 102 and to a corresponding one of the output conveyors. Sorting includes selecting, picking (e.g., grasping and lifting), and distributing (e.g., placing, throwing or dropping) each item. Each operator station allows access to the input conveyor 102 and the plurality of output conveyors (each of which leads to a corresponding one of the plurality of output collectors). For example, a first operator, at a first one of the operator stations 106, can pick rubbish, plastic, paper/cardboard, no-ferrous timber and brick, and distribute each of these five types to a corresponding output conveyor. A second operator, at a second one of the operator stations 106, can also sort the same five types of material. The items of each type of material from both operators are then carried by respective output conveyers for each type to respective output collectors.

Providing each operator access to the same plurality of types of output conveyors allows for flexibility in sorting the input stream 104. For example, if the input stream 104 includes a high proportion of timber items, each operator can pick mainly timber (in contrast to pre-existing systems where only some of the pickers could pick timber). In another example, if the number of available operators varies, the same mix of item types in the input stream 104 can still be processed by the variable number of operators, which can occur when the availability of labourers is unpredictable.

The arrangement of the sorting plant 100 can allow the mixed waste materials in the waste input stream 104 to be sorted or separated at a high flow rate, and with flexibility to adapt to changes in the rate of flow and the mix of materials (i.e., the relative proportions of each type of material). The sorting plant 100 can allow a high percentage of selectable items to be sorted from the input stream 104, thus allowing only a low percentage of items to pass through the operator stations 106 unsorted to become landfill. The contribution from each operator can be maximised and used most efficiently. The volume of recovered items can be maximised.

Figure 3:
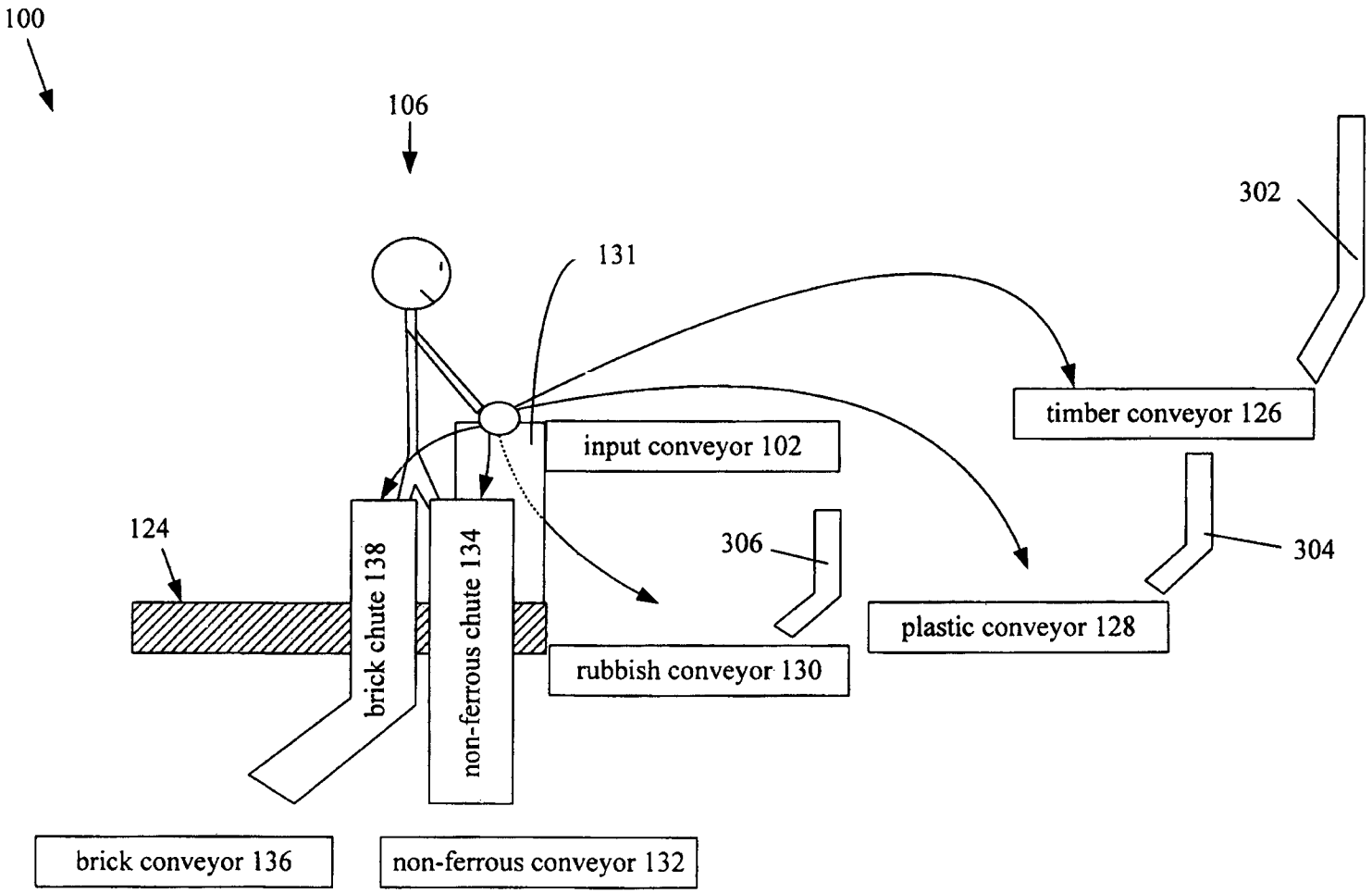
FIG. 3 is a cross-sectional view along the line in FIG. 1.

As shown in FIGS. 1 and 3, the plant 100 includes a plurality of output conveyors on the far or opposite side of the input conveyor 102 from the operator stations 106. These far-side output conveyors include a timber conveyor 126 and a plastic conveyor 128. Having these far-side output conveyors mounted in the plant 100 on the far side of the input conveyor 102 from each of the operator stations 106 allows each operator to throw items onto one of the far-side output conveyors over the input stream 104, as shown by the arrows in FIG. 3. For example, an operator can throw timber items over and beyond the input stream 104 to the timber conveyor 126, or the operator can throw plastic items over and beyond the input stream 104 to the plastic conveyor 128, as shown in FIG. 3. By throwing items over and beyond the input stream, the operator can rapidly sort certain items, particularly those which are substantially heavy and/or aerodynamic (e.g., solid objects such as timber and plastic, rather than light objects such as tissue or paper). In embodiments, an operator can sort items without needing to look at the locations of the far-side output conveyors by simply throwing items at a selected angle or height corresponding to the locations of the far-side output conveyors. As shown in FIG. 1, the far-side output conveyors are substantially open along their lengths to receive items along substantial portions of their lengths adjacent each operator station. For example, the far-side output conveyors (and other output conveyors which are accessed by throwing items, e.g., a rubbish conveyor 130 below the input conveyor 102) can be substantially uncovered and open along their lengths adjacent the operator stations to allow the operators to sort items onto these output conveyors without concern for the exact horizontal or azimuthal angle along which the item is thrown (only the vertical angle need be selected). Furthermore, having substantially open portions of the output conveyors allows items of substantially varying sizes to be sorted to an output conveyor of each type. For example, the timber conveyor 128 is substantially open along its length to allow small and large pieces of timber to be received in the corresponding output stream. This configuration of the plant 100 can be advantageous for sorting construction waste and demolition waste, which can include large planks or beams of timber, and small pieces of broken wood. Similarly, the plastic conveyor 128 is substantially open along a substantial portion adjacent the operator stations 106 for receiving both small and bulky plastic items, e.g., as are found in construction and demolition waste. Bulky plastic items and long timber pieces can be up to about 1 meter or 2 meters in length, and thus the far-side output conveyors can be configured to be open for portions that are sufficiently long to receive such large items.

Preparation

During operation of the plant 100, mixed waste (also referred to as mixed material or unsorted recyclable/recoverable rubbish), which contains a mix of items of different types, is delivered to the sorting plant 100 by being deposited into one or more shredders 110 from a delivery device such as a tip truck, a bin- or skip-bearing truck, a front-end loader and/or a hopper conveyor. The shredders 110 can size or shred the material items in the mixed waste to form items for the input stream that are suitable for sorting by the operators (e.g., small enough for sorting), but not so small that the shredded items fall through a following trommel 114 with fines (fine particles).

The mixed material is fed from the shredders 110 by conveyor belt to a feed hopper 108. The hopper 108 and its output conveyor have an adjustable flow rate, which can be selected or controlled relative to the picking station flow rate (i.e., the flow rate of the input stream 104) to a preferred rate depending on the mix of items in the mixed material and the number and speed of the available operators. The hopper 108 and its conveyor form a variable feed supply that supply the input stream to the input conveyor at a controlled flow rate. The control can be electronic, including a control box or device adjacent the walkway 124, which in electronic communication with the hopper 108 and its conveyor, to allow a user or operator to select, control or adjust the flow rate from the hopper 108 and thus the flow rate of the input stream 104.

The mixed material from the hopper 108 is carried by conveyor to a ferrous collector 112 (e.g., an overhead magnet belt), which uses magnets to separate and collect magnetic, or partially magnetic, items from the mixed material, and collect them in a ferrous collector bin. An example ferrous collector includes an upper conveyor belt rotating around a strong electromagnet suspended above the stream of mixed material carried past by a lower conveyor. The strong electromagnet pulls ferrous metal items from the stream of mixed material onto the upper conveyor, which carries the ferrous items away from the mixed material to the ferrous collector bin.

After passing through the ferrous collector 112, the mixed material is carried by conveyor to the trommel 114, which separates the mixed material into at least one fines stream 116, containing small items that fall through holes in the trommel 114, and the input stream 104 which includes larger items that are not separated and collected by any of the holes in the trommel 114. In alternative embodiments, the sorting of fines can be provided by a finger screen or a single deck screen, or other plant that can sieve the fines from the large materials, instead of the trommel 114.

The fines stream 116 is carried by conveyor belt to one or more screens 118. Each screen 118 can be an inclined, vibrating plate or sheet having holes configured to separate fines from the fines stream 116 of a selected size. Each one of the screens 118 has a corresponding fines collector 120 which collects the fines of the screen 118. The fines from each screen 118 are carried by conveyor to the corresponding fines collector 120, or may be collected by falling through the screen. Example alternative screens or screening apparatuses can include blowers or water baths etc. Example fines collectors include plastic or metal bins or simply stockpiles. The fines from the fines stream 116 which are not separated by the screens 118 are carried by conveyor to a landfill collector 122 which receives the unsorted items of the fines stream 116. The landfill collector 122 is typically a bin or skip that can be loaded onto a carrying device, such as a truck, or simply a pile of material on the ground (i.e., a stockpile). Material sorted by the screens 118 into the fines collector 120 can be fed back onto the input conveyor 102 for sorting in the input stream 104.

Operator Area

The input conveyor 102 can include one or more water sprayers for spraying water onto the input stream 104 to assist with settling dust, paper, etc. in the input stream 104.

The input stream 104 is carried by the input conveyor 102 in a path adjacent to and generally parallel to a walkway 124 which includes the one or more operator stations 106 where the operators stand during operation of the sorting plant 100.

The walkway 124 includes a suspended metal grid for supporting the plurality of operators above one or more of the output conveyors. For an example recycling plant, the number of operator stations can be between one, and about twenty, or preferably about six.

Each operator station 106 on the walkway 124 is within easy manual reaching distance of the input conveyor 102, and specifically the input stream 104, as it passes along adjacent the walkway 124. Each operator, when standing in their operator station 106, can therefore reach out to the input conveyor 102 and manually grasp any one or more of the items in the input stream 104 and pick them from the input stream 104.

Figure 2:
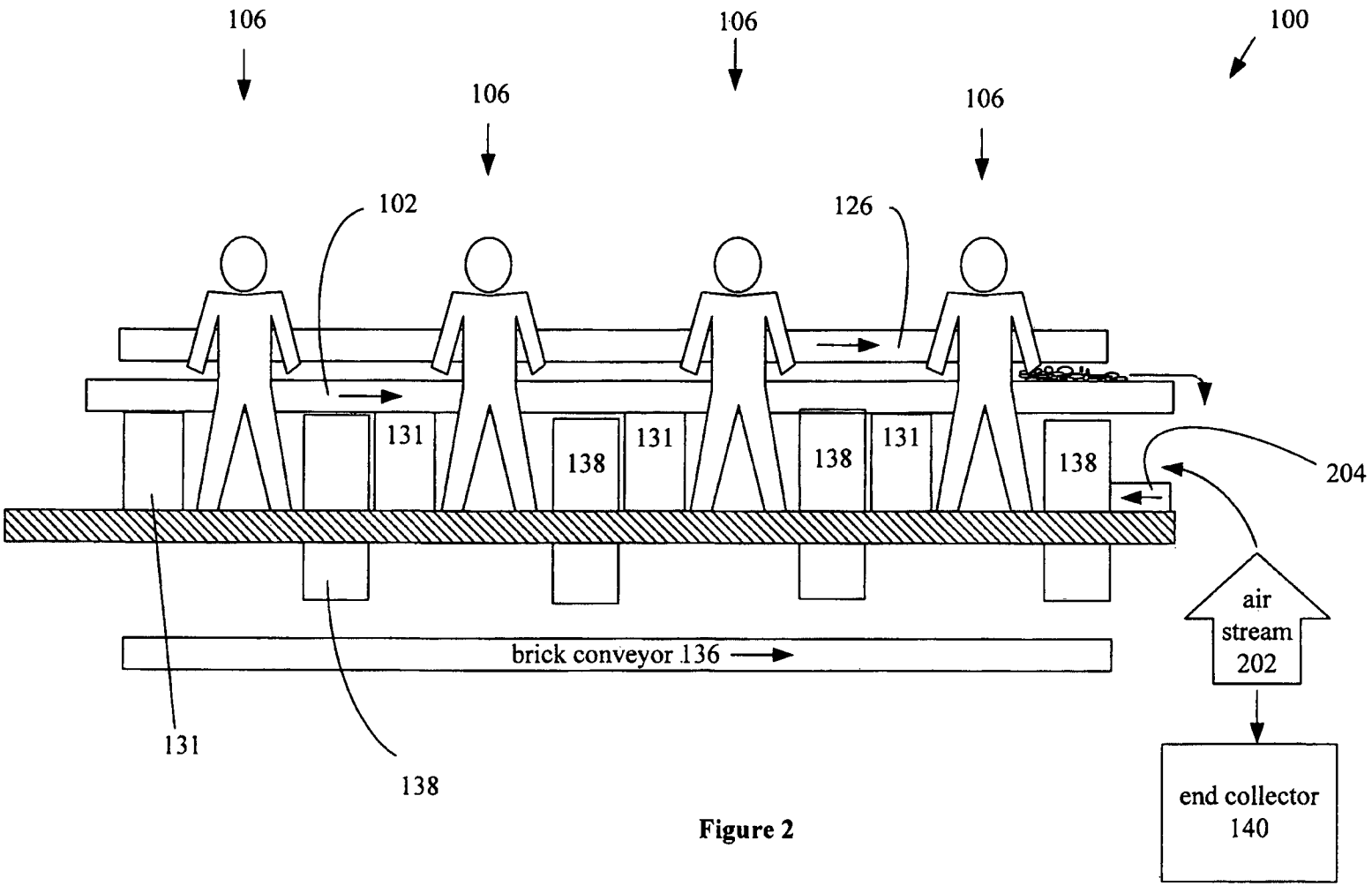
FIG. 2 is a schematic diagram of a side view of the sorting apparatus.

As shown in FIGS. 2 and 3, the input conveyor 102 is located parallel to the walkway 124, and the operator stations 106, and at a generally constant height, so the walkway and the input conveyor 102 are both generally straight and flat. The input conveyor 102 is located adjacent the operator stations 106 and substantially above the walkway 124 to allow operators standing at the operator stations 106 to easily and conveniently reach the input steam 104, e.g., without excessive reaching or bending. For example, the input conveyor 102 can be located generally at a waist height of a typical human operator, e.g., at about 0.9 to 1.1 meters above the floor where the operators stand on the walkway 124.

The plurality of output conveyors are located generally adjacent the input conveyor 102 and are aligned generally mutually parallel to the input conveyor 102, and at least generally adjacent the operator stations 106, so that the locations of the operator stations 106 allow operators to access the output conveyors in generally the same manner, regardless of which operator station 106 along the walkway 124 they are using.

The output conveyors include, as shown in FIGS. 1 and 3, the timber conveyor 126, the plastic conveyor 128, the rubbish conveyor 130, a non-ferrous conveyor 132, and a brick conveyor 136. The rubbish conveyor 130 can be operated in reverse as a cardboard/paper conveyor. In some embodiments, additional conveyors can be included for other item types, such as cardboard/paper, and/or manufactured timbers.

Each operator station 106 is configured such that heavy, aerodynamic items (e.g., timber, brick, concrete or metal) can be thrown onto an output conveyor belt over the main waste input conveyor 102, or dropped below the operator station 106, and light, non-aerodynamic items (e.g., rubbish, paper or cardboard) are dropped directly below or adjacent to the input conveyor 102. It is easier to throw heavy, aerodynamic items accurately than light, non-aerodynamic items. At least one output conveyor for a heavy item type (e.g., timber, brick or metal) is thus distant from the operator stations such that the heavy items can be thrown by the operators to the distant output conveyor past (e.g., over or under) at least one of the other conveyors. In addition, certain heavy items (e.g., concrete or rock) can be left on the input conveyor 102, and not removed to one of the output conveyors, because they can be difficult to sort manually and because they can be collected at the terminal end of the input conveyor in an end collector 140, as described hereinafter.

Each operator station 106 is also configured such that at least one output conveyor for a light item type (e.g., rubbish, paper or cardboard) is adjacent the operator stations such that light items can be dropped by the operators to the adjacent output conveyor adjacent (e.g., below or next to) the input conveyor. It is easier to drop or place light, non-aerodynamic items accurately than to throw them over a distance.

The timber conveyor 126 is located generally parallel to the input conveyor 102 adjacent the operator stations 106 and located at a height generally equal to, or slightly higher than, the input conveyor 102 (e.g., 0.1 meters above the input conveyor 102). The timber conveyor 126 is located generally on the far side of the input conveyor 102 from the operator stations 106, or at least no closer to the operator stations 106 than the input conveyor 102. The walkway 124, the operator stations 106 and the timber conveyor 126 are configured such that the timber conveyor 126 is generally at waist height for an operator with a typical height. These heights allow the operator to conveniently reach the items in the input stream 104 and throw timber items to the timber conveyor 126. The location of the timber conveyor 126 allows each operator to pick an item of timber from the input conveyor 102 and throw the item of timber across, over and beyond the input conveyor 102 and/or above the input conveyor 102 to land on the timber conveyor 126. In an example embodiment, the timber conveyor is about 1.2 meters vertically above the walkway 124, and about 1.5 meters horizontally distant from the operator stations 106.

The plastic conveyor 128 is located parallel to the input conveyor 102, generally below the input conveyor 102 and generally on the far side of the input conveyor 102 from the operator stations 106. The location of the plastic conveyor allows each operator to pick a piece of plastic (a plastic item) from the input conveyor 102 and throw it across, over and beyond the input conveyor 102 and underneath of the timber conveyor 126 to the plastic conveyor 128. In an example embodiment, the plastic conveyor is at about the same height as the walkway 124, and about 1.2 meters horizontally distant from the operator stations 106.

The timber conveyor 126 and the plastic conveyor 128 are located on the far side of the input conveyor 102 from the operator stations 106 and are substantially open (i.e., uncovered along substantial portions their lengths) to receive thrown items (of variable sizes) from a plurality of horizontal or azimuthal angles.

The rubbish conveyor 130 is located generally below the input conveyor 102, and preferably directly below the input conveyor 102. The location of the rubbish conveyor allows each operator to pick an item of rubbish from the input conveyor 102 and throw or drop the rubbish item onto the rubbish conveyor 130 underneath the input conveyor 102. The operator can also drop items of rubbish into a rubbish chute 131 located adjacent each operator station and directly adjacent the input conveyor 102 that guides items of rubbish to the rubbish conveyor 130. In an example embodiment, the rubbish conveyor 130 is about 0.3 meters vertically below the walkway 124, and directly beneath the input conveyor 102. Alternatively, the rubbish conveyor 130 can carry paper/cardboard items instead of rubbish. It can be preferable that the rubbish conveyor 130 is not too distant from the operator stations 106 because some rubbish and paper cardboard items can float and are difficult to throw.

The non-ferrous conveyor 132 is located generally below the walkway 124 to allow an operator to pick a non-ferrous item from the input conveyor 102 and drop it onto the non-ferrous conveyor 132 through a hole in the walkway 124. The hole is defined by a non-ferrous chute 134 which extends through the walkway 124. In an example embodiment, the non-ferrous conveyor 132 is about 0.4 to 0.5 meters vertically below the walkway 124, and generally directly below the operator stations 106. Alternatively, the non-ferrous items can be placed into containers standing on the walkway 124 and below the input conveyor 102, or into chutes behind operators that drop items into bins below the walkway 124 and outside the shed.

The brick conveyor 136 is located generally below the walkway 124 to receive the brick items picked from the input conveyor 102, and dropped or thrown by the operator through the walkway 124 via a brick chute 138 which guides brick items through the walkway 124 to the brick conveyor 136. In an example embodiment, the brick conveyor is about 0.4 to 0.5 meters vertically below the walkway 124, and adjacent the non-ferrous conveyor 132. The input conveyor 102 and the output conveyors include continuous conveyor belts operating on rollers, configured to carry a stream of items with weights typical of the various items in the mixed material. For example, the conveyors may be commercially available flat-bed or concave-bed conveyors.

The chutes 131, 134, 138 are located to the right and/or left of each operator station 106. For example, each non-ferrous chute 134 is located on the side of each, operator station 106 to allow the operators to pick the non-ferrous items from their front from the input conveyor 102 and drop the non-ferrous items to their side into the non-ferrous chute 134. The brick chute 138 and the rubbish chute 131 are similarly located. Additional chutes can be located adjacent the operator stations 106, e.g., to the side or behind each operator, to receive items and guide them to skips or bins below the walkway 124. The additional chutes can be used for receiving and collecting items not carried by the output conveyors, e.g., glass bottles. The bins below the walkway 124 can be accessed by a collecting device, such as a truck, for emptying the bins. The chutes can include strong permanent magnets attached thereto for holding and collecting ferrous items selected and picked by the operators, i.e., ferrous metallic items that were not removed by the ferrous collector 112. The chutes can be formed of welded metal plates, sealed to guide items that are dropped into them, and securely attached to the walkway 124 adjacent each operator station 106.

Catchment Walls

The sorting plant 100 also includes one or more catchment walls, as shown in FIG. 3, which catch items which are thrown too far by the operators.

For example, a catchment wall 302 is installed adjacent the timber conveyor 126 to catch items of timber thrown to the far side of the timber conveyor 126; a catchment wall 304 is installed adjacent the plastic conveyor 128 to catch plastic items thrown to the far side of the plastic conveyor 128; and a catchment wall 306 is installed on the far side of the rubbish conveyor 130 to catch items of rubbish thrown beyond the rubbish conveyor 130.

The catchment walls can be formed of welded metal sheets and/or wooden walls securely attached to the framework, of the sorting plant 100. The catchment walls can include with rubber or plastic skirts at their lower edges adjacent their respective conveyors for guiding items onto the conveyors.

Collectors and Blowers

The input conveyor 102 carries the input stream 104 past the operator stations 106 and the walkway 124 to the end collector 140 which collects any items from the input stream 104 which were not selected by operators at the operator stations 106. For example, the end collector 140 can be for concrete or rock items, in which case the operators do not pick concrete or rock from the input stream 104. In other embodiments, the end collector 140 can be configured to collect timber, plastic, paper/cardboard, brick, or any selected material.

The end collector 140 is located at the terminal end of the input conveyor 102, at the far end from the trommel 114 and the start of the input stream 104, and substantially below the input conveyor 102 to receive items falling from the end of the input conveyor 102. The end collector 140 may include an end collector chute to guide items from the terminating end of the input conveyor 102 into the end collector 140.

As shown in FIGS. 1 and 2, the end collector 140 can include one or more blowers 142 which blow an air stream 202 upwards as items fall from the input conveyor 102 into the end collector 140. The air stream 202 can collect blowable items from the input stream 104 which have not been picked by the operators. The blowers 142 can include a large fan blowing air up against the stream of items falling from the terminal end of the input conveyor 102. The blowers 142 can also include pipes directing air across the input conveyor 102, towards its terminal end, that lift items from the input conveyor 102. In some embodiments, the blowers 142 are configured to direct the blowable items from the input conveyor 102, or the falling stream of items, towards and onto an additional rubbish conveyor 204 that lies directly beneath the terminal end of the input conveyor 102, as shown in FIG. 2. The additional rubbish conveyor 204 carries these items to the rubbish conveyor 130. Example blowables include pieces of paper and plastic that can be rubbish items.

Each of the output conveyors, which can each include a plurality of conveyor belts, guides its output stream of selected items into a corresponding collector. The timber conveyor 126 carries timber items to a timber collector 144. The plastic conveyor carries plastic items to a plastic collector 146. The rubbish conveyor 130 carries rubbish items to a rubbish collector 148. The non-ferrous conveyor 132 carries items to a non-ferrous collector 150. The brick conveyor 136 carries brick items to a brick collector 152. Each of the output collectors can include, for example, a hopper or bin placed below the terminal end of each output conveyor for receiving items falling from the output conveyor into the corresponding collector. The output collectors can include simply a space for the output stream to land, thus forming a heap of sorted material. Each collector is configured to be accessible from below or from the side by a collecting device, such as a truck, or alternatively each output collector may be formed to be exchanged, when full, for an empty collector of the same general dimensions (e.g., a skip or bin).

Balers

The output conveyors can be reversible to allow one or more of the output streams to be delivered to alternative terminal ends of these output conveyors.

The plastic conveyor 128 can be reversed in direction to carry the stream of plastic items to a plastic picker station 154, for optional additional picking of the plastic, and then to a plastic baler 156 for receiving the plastic items and subsequently baling them.

The rubbish conveyor 130 can be reversed in direction and used as a paper/cardboard conveyor to carry a stream of paper/cardboard items to a paper/cardboard picker station 158, where additional picking of the paper/cardboard can occur. The picked paper/cardboard items are then carried to a paper/cardboard baler 160 which receives and bales the paper/cardboard for transport/storage/etc.

The balers 156, 160 are standard commercially available balers which receive the sorted items, compress them, and store them in bales for disposal.

Speed Control

The speed of the input stream 104 can be selected based on the mix of materials and/or number of operators available and controlled by an operator (or user) using a control dial in an electrical control panel, of a plant control system, situated towards the rear of the walkway 124.

Sorting Method

Figure 4:
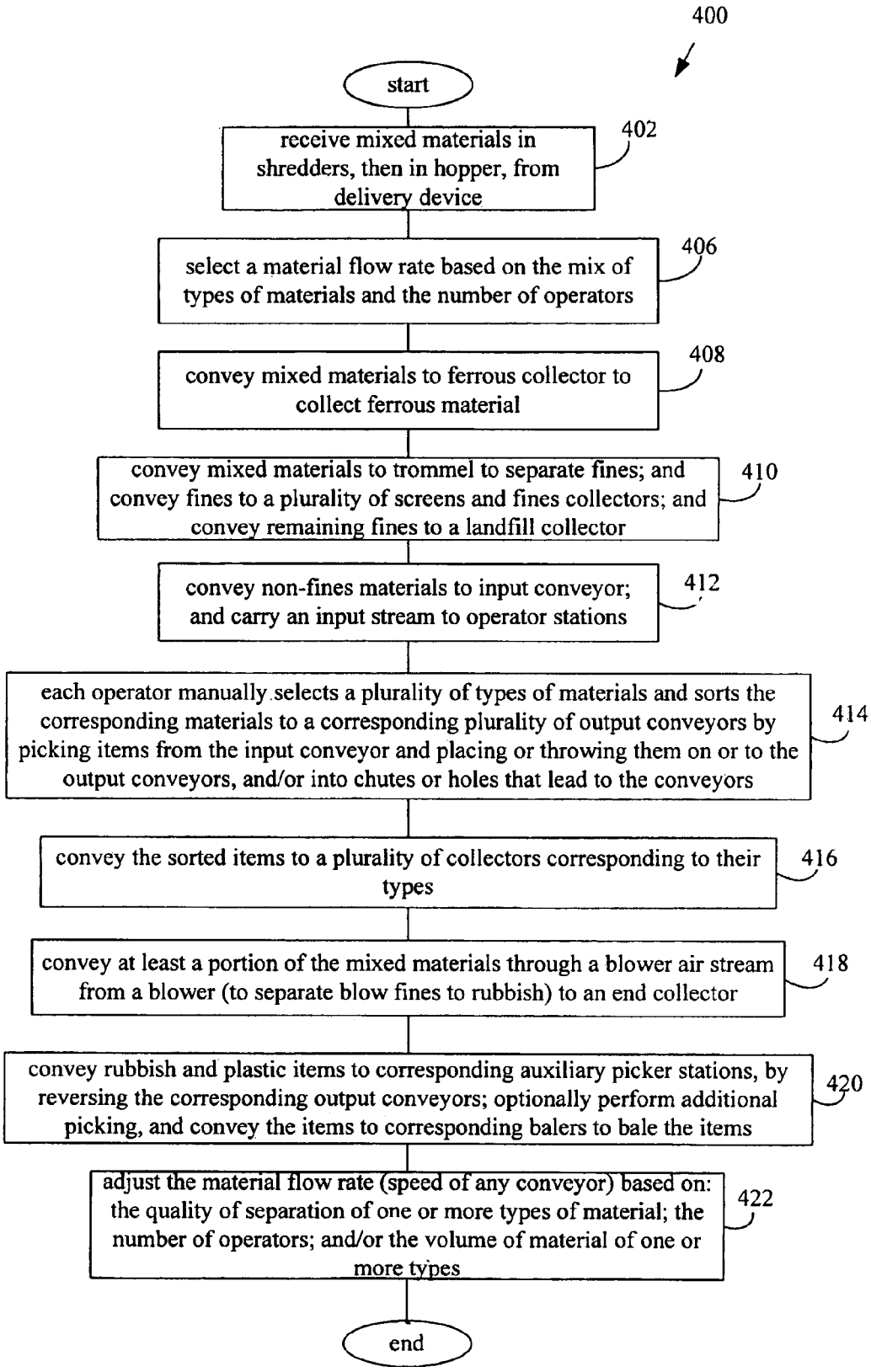
FIG. 4 is a flow diagram of a sorting method performed using the sorting apparatus.

In use, the sorting plant 100 performs a sorting method 400, as shown in FIG. 4, commencing with the shredders 110 and the hopper 108 receiving mixed materials from a delivery device (step 402). A material flow rate for the input stream 104 on the input conveyor 102 is selected based on the mix of materials and the number of operators at the operator stations 106 (step 406).

The shredded mixed materials are carried to the ferrous collector 112 to collect the ferrous items, e.g., iron, magnetic materials, etc. (step 408).

The mixed materials are carried to the trommel 114 to separate fines. The fines are carried to the plurality of the screens 118, and the fines collectors 120 or the landfill collector 122 (step 410).

The input materials which are not separated into the fines stream 116 are conveyed to the input conveyor 102 and then, as part of the input stream 104 they are carried past the operator stations 106 (step 412).

When the items in the input stream 104 are adjacent each operator, the operator manually selects one or more items from the input stream 104 corresponding to one or more of the plurality of types in the mixed materials, and sorts these items to the respective output conveyors by picking an item from the input conveyor and manually distributing (e.g., by placing, throwing or dropping) it to one of the output conveyors selected based on the type of the selected item (step 414). Manually distributing the items to the output conveyors can include using the chutes or holes that lead from the operator stations 106 to the output conveyors.

After sorting, the sorted items are conveyed to the plurality of output collectors by the respective output conveyors for each type of sortable material, e.g., timber, brick, non-ferrous material, plastic, rubbish; concrete, etc. (step 416).

A portion of the mixed materials can be conveyed by the input conveyor 102 to its terminal end and to the end collector 140 (step 418). The end collector 140 can collect items that are subsequently used as recyclable materials, e.g., concrete. Conveying the unpicked materials in the input stream 104 to the end collector 140 includes conveying them through the blower 142 and the blower air stream 202 to separate any remaining blowable items.

The conveying direction of at least one of the output conveyors can be reversed, and the associated items can be carried to the auxiliary picking stations 154, 158 and then to the balers 156, 160 to bale the items (step 420). Reversing the conveying direction and baling the items can be performed for the plastic items and the paper/cardboard items by reversing the plastic conveyor 128 and the rubbish conveyor 130 (also referred to as the paper/cardboard conveyor) respectively to deliver the items to the respective plastic baler 156 and paper/cardboard baler 160.

The flow rate of the input stream 104 is adjusted by an operator or user during operation of the sorting plant 100 based on the quality of separation of the one or more types of material, and the extent to which all output materials have been picked from the input stream 104 when it reaches the terminal end of the input conveyor 102 (step 422).

Housing

The sorting plant 100 is housed in a large barn or shed, which provides substantial protection from sun, wind and rain for the operators and for items that can be blown away or can be broken apart or stuck together when wet. An example housing is formed of a welded steel frame, substantially protecting the operators, input conveyor and output conveyors, with the conveyors and their motors welded or bolted in place to the frame.

Alternative Embodiments

In some embodiments, the material type of each conveyor of the conveyors in FIG. 3 can be changed or swapped, so the conveyors sort different materials, e.g., based on the materials in the unsorted mix.

In some embodiments, at least portions of the sorting apparatus 100 (including the input conveyor 102, the operator stations 106 and a plurality of the output conveyors) can be sized to fit into container for carrying on a prime mover so as to be easily relocatable and transportable to sites where mixed materials are to be sorted.

In some embodiments, one or more of the conveyors can include conveying means other than conveyor belts, for example: a flow of water carrying or pushing items in a channel or pipe; a flow of air pushing items along a channel or pipe; a sloped channel, along which items slide under the force of gravity (e.g., a shaking channel); etc.

Interpretation

Many modifications will be apparent to those skilled in the art without departing from the scope of the present invention.

RELATED APPLICATIONS

The originally filed specification of the following related patent application is hereby incorporated by reference:

Australian Provisional Patent Application No. 2010902380 (filed on 31 May 2010 in the name of Manuel Samarkos).

PARTS LIST

| Part Number | Associated Phrase |
|---|---|
| 100 | sorting plant |
| 102 | input conveyor |
| 104 | input stream |
| 106 | operator stations |
| 108 | hopper |
| 110 | shredders |
| 112 | ferrous collector |
| 114 | trommel |
| 116 | fines stream |
| 118 | screens |
| 120 | fines collectors |
| 122 | landfill collector |
| 124 | walkway |
| 126 | timber conveyor |
| 128 | plastic conveyor |
| 130 | rubbish conveyor |
| 131 | rubbish chute |
| 132 | non-ferrous conveyor |
| 134 | non-ferrous chute |
| 136 | brick conveyor |
| 138 | brick chute |
| 140 | end collector |
| 142 | blower |
| 144 | timber collector |
| 146 | plastic collector |
| 148 | rubbish collector |
| 150 | non-ferrous collector |
| 152 | brick collector |
| 154 | plastic picker station |
| 156 | plastic baler |
| 158 | paper/cardboard picker station |
| 160 | paper/cardboard baler |
| 202 | air stream |
| 204 | additional rubbish conveyor |
| 302 | catchment wall |
| 304 | catchment wall |
| 306 | catchment wall |
| 400 | sorting method |

The invention claimed is:

1. A waste sorting apparatus including:

an input conveyor for conveying an input stream of mixed waste materials including items of a plurality of different types;

a plurality of output conveyors for conveying respective output streams of said waste materials; and a plurality of operator stations for respective human operators, wherein the input conveyor and the plurality of output conveyors are configured to be accessible from each operator station to allow each operator to sort items of said different types from the input stream to respective ones of the output streams, each of the output streams including sorted items of a corresponding one of said types, and wherein the output conveyors include a plurality of far-side output conveyors on the far side of the input conveyor from the operator stations, at least substantially parallel to the input conveyer, and having open areas to receive items along a substantial portion of each far-side output conveyor's length adjacent each operator station, to allow each operator at each operator station to throw items to the far-side output conveyors over the input conveyor.

2. The waste sorting apparatus of claim 1, wherein the number of output conveyors is two, three, four, or five.

3. The waste sorting apparatus of claim 1, configured such that each operator can sort the items from the input stream to the plurality of output streams by manually distributing the items onto the respective output conveyors, wherein manually distributing includes one or more of placing, throwing, dropping, or dropping through chutes leading from the operator stations to one or more of the output conveyors.

4. The waste sorting apparatus of claim 1, wherein a flow rate of the input stream is controlled based on:

the quality of separation of the items into the plurality of output streams; and/or the number of operators at the operator stations, wherein waste sorting apparatus includes a variable feed supply to supply the input stream to the input conveyor at the controlled flow rate.

5. The waste sorting apparatus of claim 1, wherein at least one output conveyor for a first item type is configured to operate in reverse as an output conveyor for a second item type.

6. The waste sorting apparatus of claim 1, including at least one shredder for shredding mixed waste to form items in the input stream suitable for sorting by the operators.

7. The waste sorting apparatus of claim 1, wherein at least one output conveyor for a heavy item type is distant from the operator stations such that heavy items can be thrown by the operators to the distant output conveyor past or over at least one of the other conveyors.

8. The waste sorting apparatus of claim 1, wherein at least one output conveyor for a light item type is adjacent the operator stations such that light items can be dropped or placed by the operators onto the adjacent output conveyor.

9. A waste sorting method including:

conveying an input stream of mixed waste materials including items of a plurality of different types to a plurality of human operators;

sorting by the human operators of items of different types from the input stream to respective ones of a plurality of output streams; and conveying the plurality of output streams from the human operators, each of said output streams including sorted items of a corresponding one of said types, wherein the sorting includes throwing items of a plurality of types over and beyond the input stream to substantially open portions along lengths of respective ones of far-side output conveyors, corresponding to said output streams, that are at least substantially parallel to the input stream.

10. The waste sorting method of claim 9, wherein the plurality of output streams includes two, three, four or five output streams.

11. The waste sorting method of claim 9, wherein the output streams are parallel to the input stream.

12. The waste sorting method of claim 9, including controlling a flow rate of the input stream based on:

the quality of separation of the items into the plurality of output streams; and/or the number of operators.

13. The waste sorting method of claim 9, including:

the operators throwing heavy items to at least one output stream past or over at least one of the other streams; and/or the operators dropping light items to at least one output stream adjacent the input stream.

14. The waste sorting method of claim 9, including shredding mixed waste to form items in the input stream suitable for sorting by the operators.

15. The waste sorting method of claim 9, including operating at least one output conveyor for a first item type in reverse as an output conveyor for a second item type.

16. The waste sorting apparatus of claim 1, wherein the output conveyors include an output conveyor that is below the input conveyor and adjacent the operator stations such that each operator can drop items onto said below output conveyor.

17. The waste sorting apparatus of claim 1, wherein one of the far-side output conveyors is at a height generally equal to, or slightly higher than, the input conveyor.

18. The waste sorting apparatus of claim 1, wherein one of the far-side output conveyors is underneath another of the far-side output conveyors.

19. The waste sorting method of claim 9, wherein the sorting includes dropping items onto an output conveyor that is below the input conveyor and adjacent the operator stations.

20. The waste sorting method of claim 9, wherein the throwing includes throwing items of a first type over and beyond the input stream to a first far-side output conveyor, of the plurality of far-side output conveyors, at a height generally equal to, or slightly higher than, the input conveyor.

21. The waste sorting method of claim 9, wherein the throwing includes:

throwing items of a first type over and beyond the input stream to a first far-side output conveyor; and throwing items of a second type over and beyond the input stream to a second far-side output conveyor, wherein the first far-side output conveyor is underneath the second far-side output conveyor.

* * * * *